US008498564B2

(12) United States Patent
Kamimura et al.

(10) Patent No.: US 8,498,564 B2
(45) Date of Patent: Jul. 30, 2013

(54) FIXING ROLLER/FIXING BELT, AND PROCESS FOR MANUFACTURING THE SAME

(75) Inventors: Hiromi Kamimura, Osaka (JP); Yoshimasa Suzuki, Osaka (JP); Kazuhiro Kizawa, Osaka (JP)

(73) Assignee: Sumitomo Electric Fine Polymer, Inc., Osaka (JP)

( * ) Notice: Subject to any disclaimer, the term of this patent is extended or adjusted under 35 U.S.C. 154(b) by 676 days.

(21) Appl. No.: 12/595,124

(22) PCT Filed: Apr. 11, 2008

(86) PCT No.: PCT/JP2008/057153

§ 371 (c)(1),
(2), (4) Date: Oct. 8, 2009

(87) PCT Pub. No.: WO2008/126915

PCT Pub. Date: Oct. 23, 2008

(65) Prior Publication Data

US 2010/0104335 A1 Apr. 29, 2010

(30) Foreign Application Priority Data

Apr. 11, 2007 (JP) ..... 2007-103966

(51) Int. Cl.
*G03G 15/20* (2006.01)

(52) U.S. Cl.
USPC ..... 399/333; 399/122; 399/320; 399/330

(58) Field of Classification Search
USPC ..... 399/122, 320, 330, 333, 400
See application file for complete search history.

(56) References Cited

U.S. PATENT DOCUMENTS

| | | | | |
|---|---|---|---|---|
| 5,403,995 | A * | 4/1995 | Kishino et al. | 219/216 |
| 2007/0296122 | A1 * | 12/2007 | Chen et al. | 264/346 |

FOREIGN PATENT DOCUMENTS

| | | | |
|---|---|---|---|
| JP | 64-001534 | | 1/1989 |
| JP | H06-11985 | * | 1/1994 |
| JP | 10-142988 | | 5/1998 |
| JP | 3584682 | | 12/1998 |
| JP | 2004-276290 | | 10/2004 |
| JP | 2005-238765 | | 9/2005 |
| WO | 2004/018201 | | 3/2004 |

* cited by examiner

*Primary Examiner* — Walter L Lindsay, Jr.
*Assistant Examiner* — Roy Y Yi
(74) *Attorney, Agent, or Firm* — Drinker Biddle & Reath LLP

(57) ABSTRACT

A fixing roller/fixing belt having an elastic layer and a surface layer formed on a substrate material in the enumerated order, wherein the surface layer is a layer formed by thermally shrinking a PFA tube, and the surface layer and the elastic layer are bonded together through a PFA-containing adhesive material. In particular, a fixing roller/fixing belt in which the ratio of heat shrinkage of the PFA tube forming the surface layer is 3 to 20%. Also, a fixing roller/fixing belt, in which the quantity of PFA contained in the PFA-containing adhesive material is 20 to 30 wt %.

3 Claims, 3 Drawing Sheets

FIXING ROLLER/FIXING BELT, AND PROCESS FOR MANUFACTURING THE SAME

TECHNICAL FIELD

The present invention relates to a fixing roller/fixing belt, which is used in a copier or the like, and to a process of making the same.

BACKGROUND ART

Generally, the structure of a fixing roller/fixing belt used in a copier and the like is such that a cylindrical substrate has a rubber layer formed as an elastic layer thereon, and a surface layer made of fluororesin such as tetrafluoroethylene-perfluoroalkylvinylether copolymer (PFA) or polytetrafluoroethylene (PTFE) is formed on the elastic layer. Here, the fixing roller/fixing belt is a roller or a belt that is used for a fixing part in a copier. Examples of the process for manufacturing such a fixing roller/fixing belt are described in Patent Document 1. In the following explanation, PFA is adopted as an example of the fluororesin used for the surface layer.

That is, an adhesive is applied to the surface of the cylindrical substrate and the adhesive is bonded with a rubber layer (e.g., silicone-based rubber) formed thereon. Apart from this, PFA is applied onto the inner circumferential surface of a circular mold (a pipe), and after baking, the PFA is pulled out in a tubular form from the circular mold. The inner diameter of this tubular PFA is designed to be a little smaller than the outer diameter of the circular rubber layer. Moreover, in order to enhance the adhering strength relative to the below-described adhesive for a surface layer, the inner circumferential surface of the tubular PFA is treated (plasma treatment, chemical etching, or the like).

Next, the tubular PFA is radially expanded to increase the inner diameter, and it is compulsorily inserted over a cylindrical substrate having a rubber layer whose outer circumferential surface is previously coated with a surface-layer adhesive (silicone-based rubber). The surface-layer adhesive is comparatively thickly applied so that it may also function as a lubrication enabling the PFA to be smoothly inserted over the rubber layer. Thereafter, the circumferential surface of the tubular PFA is made flat and smooth by squeezing the surface of the tubular PFA to remove the excess of the surface-layer adhesive existing between the tubular PFA and the rubber layer and to remove wrinkles, sagging, etc. of the tubular PFA and voids which have occurred between the tubular PFA and the rubber layer when the tubular PFA is inserted over the cylindrical substrate. Further, a PFA layer is formed by bonding the inner circumferential surface of the tubular PFA to the outer circumferential surface of the rubber layer through the surface-layer adhesive by heating for a pre-determined time at a temperature of 220° C.

A technique for covering a fluororesin layer, which is to become a surface layer, on an elastic layer formed on a cylindrical substrate is described in Patent Document 2. The technique is such that the outside of the elastic layer and the fluororesin layer are covered with a heat-shrinkable tube that has been shrunk by heating, and thereafter the fluororesin layer is baked by heating so that the internal shape of the heat-shrinkable tube is transcribed to the surface of the fluororesin layer. In such case, the heat-shrinkable tube is removed after the inner shape thereof has been transcribed to the surface of the fluororesin layer.

The technique described in Patent Document 3 is such that a columnar body that has been treated in advance with a primer is covered with a heat-shrinkable tube made of fluororesin (PFA) and the heat-shrinkable tube is shrunk to be fixed at a temperature (80 to 250° C.) less than the melting point thereof and is heat-bonded at a temperature (330 to 400° C.) above the melting point.

[Patent Document 1] Japanese Patent Application Publication No. 2004-276290

[Patent Document 2] Japanese Patent Application Publication No. H10-142988

[Patent Document 3] Japanese Patent Application Publication No. S64-1534

DISCLOSURE OF INVENTION

Problems to be Solved by the Invention

In recent years, the environment relating to the use of OA equipment has become more and more severe, while the demand for miniaturization and cost reduction of OA equipment has become stronger.

As described above, the fixing roller/fixing belt of Patent Document 1 requires a process for squeezing the surface of the tubular PFA after the rubber layer is covered with the tubular PFA. However, this process is complicated and has been a cause of increase in the manufacturing cost.

Also, the fixing roller/fixing belt of Patent Document 1 requires the inner circumferential surface of the tubular PFA to be subjected to a treatment (plasma treatment, chemical etching, etc.) so that the adhesiveness with respect to the surface-layer adhesive may be enhanced. Therefore, it has been difficult to decrease the inner diameter of a PFA tube because a space for inserting a jig for the inner surface treatment must be secured. Consequently, it has been difficult to manufacture a small-diameter fixing roller or a fixing belt. In this respect, it might be possible to perform the inner surface treatment for a small-diameter PFA tube (the caliber is 18 mm or less) by adopting laser etching as the inner surface treatment; however the problem thereof has been high processing cost.

The fixing roller/fixing belt is used for fixing the toner transcribed to a recording paper, and therefore it is used under the conditions heated with a heater arranged therein. In the case of a copier having fast printing speed, the temperature of the fixing roller/fixing belt tends to decrease because the fixing roller/fixing belt is robbed of the heat by a number of recording papers. Therefore, the thickness of the fixing roller/fixing belt must be made thinner so that the heat of the heater may be efficiently transmitted and the temperature of the fixing roller/fixing belt may not be decreased.

However, in the case of the fixing roller/fixing belt of Patent Document 1, the surface-layer adhesive is comparatively thickly applied in order to enhance such lubrication property of the surface-layer adhesive as is exhibited when the tubular PFA is inserted over the cylindrical substrate having a rubber layer on whose outer circumferential surface the surface-layer adhesive is coated. Accordingly, the thickness of the adhesive layer between the PFA layer and the rubber layer becomes thicker (typically, about 15 μm). Consequently, the thermal loss has been significant since the heat of the heater arranged inside the fixing roller/fixing belt does not spread efficiently.

Also, it was impossible to avoid the thermal degradation of the rubber layer that was caused by baking treatment after the insertion of the tubular PFA. In addition, a shortcoming of the techniques of Patent Document 2 and Patent Document 3 is that the rubber layer deteriorates because the baking temperature is above the melting point of the PFA and the baking time is long.

Therefore, an object of the present invention is to provide a fixing roller/fixing belt for which neither the squeezing process nor the inner surface treatment of the PFA is needed and in which the thickness of the adhesive layer between the surface layer and the elastic layer is made thinner, resulting in not only decrease in the diameter and the manufacturing cost, but also decrease in the thermal loss and the degradation of the elastic layer. Another object of the present invention is to provide a method of making such fixing roller/fixing belt.

Means for Solving the Problem to be Solved

The present inventor was engaged in intensive investigations and studies, and as a result, completed the present invention on the basis of finding that the above-mentioned problems can easily be solved if PFA having heat-shrinkable property is used without the internal treatment of the inner circumferential surface and if the bonding method for the surface layer and the elastic layer is contrived using a PFA-containing adhesive material as the adhesive between the surface layer and the elastic layer. Hereinafter, the invention will be explained with respect to each claim.

The invention specified in claim 1 is a fixing roller/fixing belt in which an elastic layer and a surface layer are formed on a substrate material in the enumerated order, wherein the surface layer is a layer formed by thermally shrinking a PFA tube, and the inner circumferential surface of the PFA tube is not subjected to the internal treatment.

According to the invention of this claim, it is possible to provide a low-cost small-diameter fixing roller/fixing belt having less thermal loss and less deterioration of the elastic layer since a heat-shrinkable PFA tube that is not subjected to the inner surface treatment for the inner circumferential surface is used as a material for the surface layer.

The invention specified in claim 2 is a fixing roller/fixing belt as specified in claim 1, in which an elastic layer and a surface layer are formed on a substrate material in the enumerated order, wherein the surface layer is a layer formed by heat-shrinking a PFA tube, and the surface layer and the elastic layer are bonded together through a PFA-containing adhesive material.

According to the invention of this claim, a PFA tube having heat-shrinkable property is used as a material for the surface layer, and a PFA-containing adhesive material is used as a surface-layer adhesive for bonding the surface layer and the elastic layer together. Therefore, strong adhering strength is obtained between the surface layer and the adhesive since the PFA tube for the surface layer and the PFA of the surface-layer adhesive are bonded at melting point by heating at a temperature above the melting point of the PFA at the time of bonding the elastic layer and the surface layer. As a result, the treatment (plasma treatment, chemical etching, or the like) of the inner circumferential surface of the PFA tube is unnecessary, which otherwise has been necessary in the past. Moreover, since it is unnecessary to insert an inner surface treatment jig into the PFA tube, the caliber of the PFA tube can be decreased, and accordingly a small-diameter fixing roller/fixing belt can be obtained. Also, the heating time may be a moment, which results in restraining the deterioration of the rubber layer.

In the invention of this claim, the PFA is adopted as fluororesin because in the case of PTFE the melting point is higher than the melting point of PFA and hence it will be necessary to perform bonding treatment between the elastic layer and the surface layer at higher temperature, which might cause the deterioration of the rubber layer.

From the viewpoint of heat resistance and mechanical strength, a heat resistant resin and metal are used as a substrate material. Examples of the heat resistance resin include polyimide resin and polyamide-imide resin, and examples of the metal include stainless steel, aluminum, and iron.

The invention specified in claim 3 is a fixing roller/fixing belt as specified in claim 1 or claim 2, wherein the ratio of heat shrinkage of the PFA tube forming the surface layer is 3 to 20%.

According to the invention of this claim, since the ratio of heat shrinkage of the PFA tube is 3 to 20%, the inner diameter of the PFA tube can be designed to be slightly larger than the diameter of outer circumferential surface of the elastic layer, and consequently the substrate having an elastic layer can smoothly be inserted in the PFA tube. Moreover, heating causes the PFA tube to shrink so as to cover the elastic layer at moderate pressing force (stress). An example of the PFA tube having a heat shrinkable property is SMT, which is made by Gunze Limited. The SMT is a PFA tube having a shrinkage of about 5 to 10% in a radial direction at a heating temperature of 180 to 200° C.

The invention specified in claim 4 is a fixing roller/fixing belt as specified in any of claims 1 to 3, wherein the quantity of PFA contained in the PFA-containing adhesive material is 20 to 30 wt %.

According to the invention of this claim, since the quantity of PFA contained in the surface-layer adhesive material is 20 to 30 wt %, the PFA of the surface layer and the PFA of the adhesive material are surely fusion bonded at melting point, and accordingly the surface layer and the adhesive material are firmly bonded together. Preferably, the adhesive material is an aqueous dispersion (one made by dispersing minute PFA particles in water) since it can be used in a spray condition and is suitable for forming a thin film. An example of such material is PR-990CL made by Du Pont-Mitsui Fluorochemicals Co., Ltd. This adhesive material contains PFA by 20 to 30 wt % and its melting point is 300 to 310° C. (PFA).

The temperature for bonding the surface layer and the adhesive material is preferably 300 to 320° C. If the temperature is less than 300° C., it is not preferable in terms of bonding at melting-point. On the other hand, if the temperature exceeds 320° C., the decomposition of an elastic body will occur, resulting in a failure of the bonding performance.

The invention specified in claim 5 is a fixing roller/fixing belt as specified in any of claims 1 to 4, wherein the elastic layer is a silicone-based rubber.

In the invention of this claim, rubber is used as a material of the elastic layer. In particular, by using a silicone-based rubber, it is possible to obtain an elastic layer which is superior in terms of heat resistance, elasticity, etc.

The invention specified in claim 6 is a method of making a fixing roller/fixing belt in which an elastic layer and a surface layer are formed on a substrate material in the enumerated order. The method comprises: applying a PFA-containing adhesive material to the outer circumferential surface of the elastic layer formed on the substrate material; inserting the substrate material into a PFA tube having a heat shrinkable property; and thereafter heating the PFA tube at a temperature above the melting point of the PFA so as to cause the PFA tube to shrink such that the outer circumferential surface of the elastic layer and the inner circumferential surface of the PFA tube are bonded together with the PFA-containing adhesive material so that a PFA layer is formed as the surface layer on the elastic layer.

According to the invention of this claim, since the inner diameter of the PFA tube having a heat shrinkable property is slightly larger than the diameter of the outer circumferential surface of the elastic layer before the heat shrinking treatment, it is possible to smoothly insert the PFA tube over the substrate material having an elastic layer formed thereon.

Therefore, the surface-layer adhesive material for bonding the PFA tube and the elastic layer is not required to have a lubricating function, and accordingly the thickness can be made thinner (5 μm or less). Consequently, the heat of a heater arranged inside the fixing roller/fixing belt spreads efficiently and accordingly the thermal loss can be decreased.

Also, in the method of this claim, by heating at a temperature above the melting point of the PFA, the PFA tube is heat-shrunk and the PFA tube and the PFA of the surface-layer adhesive material are fused to integrate together so that the outer circumferential surface of the elastic layer and the inner circumferential surface of the PFA tube are adhered at melting point through the surface-layer adhesive material. Thus, a PFA layer having a smooth and flat outer circumferential surface can be formed on the elastic layer such that any excessive surface-layer adhesive material will hardly exist between the PFA tube and the rubber layer, and at the time of insertion of the substrate material the bubbles which otherwise might occur between the PFA tube and the rubber layer will hardly occur and the wrinkle and sagging of the PFA tube will not easily occur. As a result, the process of squeezing the surface of the PFA tube will be either unnecessary or simplified, enabling low-cost production of fixing rollers/fixing belts.

Also, for the purpose of bonding at melting point, heating is done at a temperature above the melting point of the PFA, but the temperature may be 310° C., for example, and moreover the heating time may be short. Since such low-temperature short-time bonding is possible, such a long-time high temperature (330 to 400□) heating for bonding as described in Patent Document 3 is unnecessary, allowing suppression of the thermal deterioration of rubber elastic layer.

Advantageous Effect of the Invention

According to the present invention, it is possible to provide a small-diameter fixing roller/fixing belt, as well as the method of making the same, for which neither the inner surface treatment of the PFA nor the squeezing process is needed and in which the thickness of the adhesive layer between the surface layer and the elastic layer is thin, resulting in less thermal loss and less degradation of the elastic layer.

DESCRIPTION OF REFERENCED NUMERALS

1 cylindrical substrate; 2 elastic layer; 2*a* liquid silicone rubber; 3 surface layer; 3*a* PFA tube; 4 adhesive layer for the elastic layer; 5 adhesive layer for the surface layer

BEST MODE FOR CARRYING OUT THE INVENTION

Hereinafter, the present invention will be described based on its best embodiment modes. However, the present invention is not limited to the following modes of embodiment, and it is possible to add various modifications to them within the scope of or equivalence to the present invention.

Figure 1:
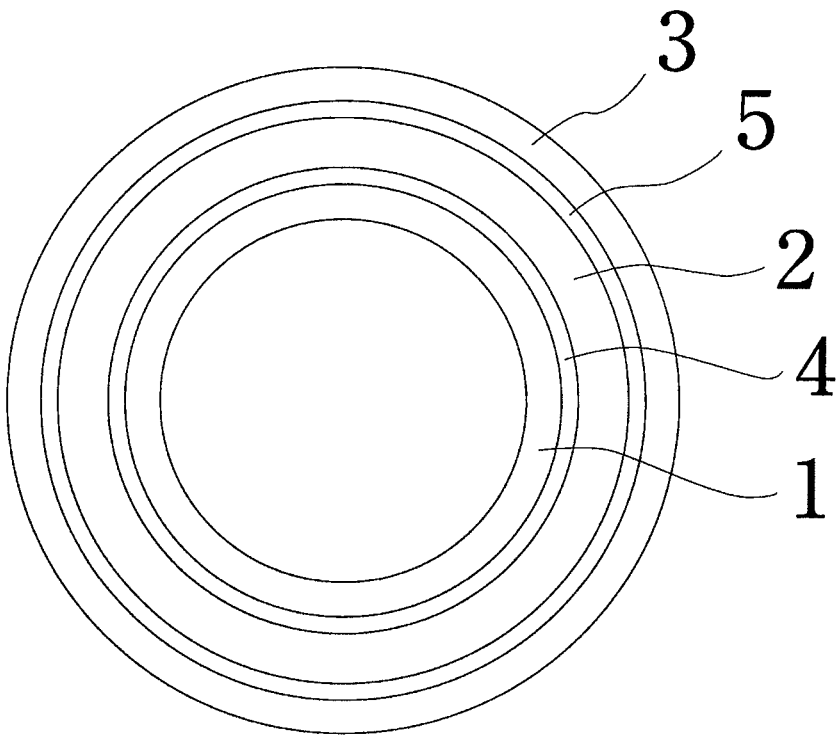
FIG. 1 is a conceptional schematic diagram showing the section of a fixing roller/fixing belt according to an embodiment of the present invention.

FIG. 1 is a conceptional schematic diagram showing the section of a fixing roller/fixing belt according to an embodiment of the present invention. In FIG. 1, 1 is a substrate material (hereinafter, also referred to as a cylindrical substrate); 2 is an elastic layer; 3 is a surface layer; 4 is an adhesive layer for the elastic layer; and 5 is an adhesive layer for the surface layer. The structure of the fixing roller/fixing belt is such that the adhesive layer 4 for the elastic layer, the elastic layer 2, the adhesive layer 5 for the surface layer, and the surface layer 3 are piled on the substrate material 1 in the enumerated order.

The cylindrical substrate 1 has a cylindrical form in the case of the fixing roller and an endless belt form in the case of the fixing belt. There is a heater or the like provided inside the circular cylinder or the endless belt, although it is not illustrated. A heat resistant polyimide resin or polyamide-imide resin, or a metal such as stainless steel, aluminum, or iron is used as a material of the cylindrical substrate 1. In the case of the fixing roller, aluminum or iron is used for the cylindrical substrate 1, for example, and the thickness is 0.5 to 3 mm. In the case of the fixing belt, for example, stainless steel or a polyimide resin is used for the cylindrical substrate 1, and the thickness is 10 to 100 μm (typically, about 30 μm in the case of stainless steel, and about 50 μm in the case of polyimide resin).

As for the elastic layer 2, a heat-resistant rubber such as silicone-based rubber or the like having a heat resistance is used as the material, and the thickness is 150 μm to 1 mm (typically, about 200 μm). The heat-resistant rubber as used herein means a rubber having heat resistance that is capable of withstanding a continued use at a fixing temperature. More specifically, examples of the heat-resistant rubber include silicone rubbers, such as dimethyl silicone rubber, fluoro silicone rubber, methylphenyl silicone rubber, vinyl silicone rubber, etc.

As for the surface layer 3, a PFA tube having heat shrinkable property is used as the material and the thickness is 10 to 50 μm (typically, about 15 to 30 μm). The heat shrinking ratio of the PFA tube is preferably 3 to 20% to secure a uniform pressing force against the elastic layer 2.

The adhesive layer 4, which is used for bonding the elastic layer 2 and the cylindrical substrate 1, has a thickness of 1 to 20 μm (typically, about 3 to 5 μm).

The adhesive layer 5 for the surface layer, which is used for bonding the elastic layer 2 and the surface layer 3, has a thickness of 1 to 30 μm (typically, 5 μm or less). From the viewpoint of securing the melting-point bonding between the PFA tube of the surface layer 3 and the PFA of the adhesive layer 5 for the surface layer, the amount of PFA contained in the adhesive material for the elastic layer is preferably 20 to 30 wt %.

Figure 2:
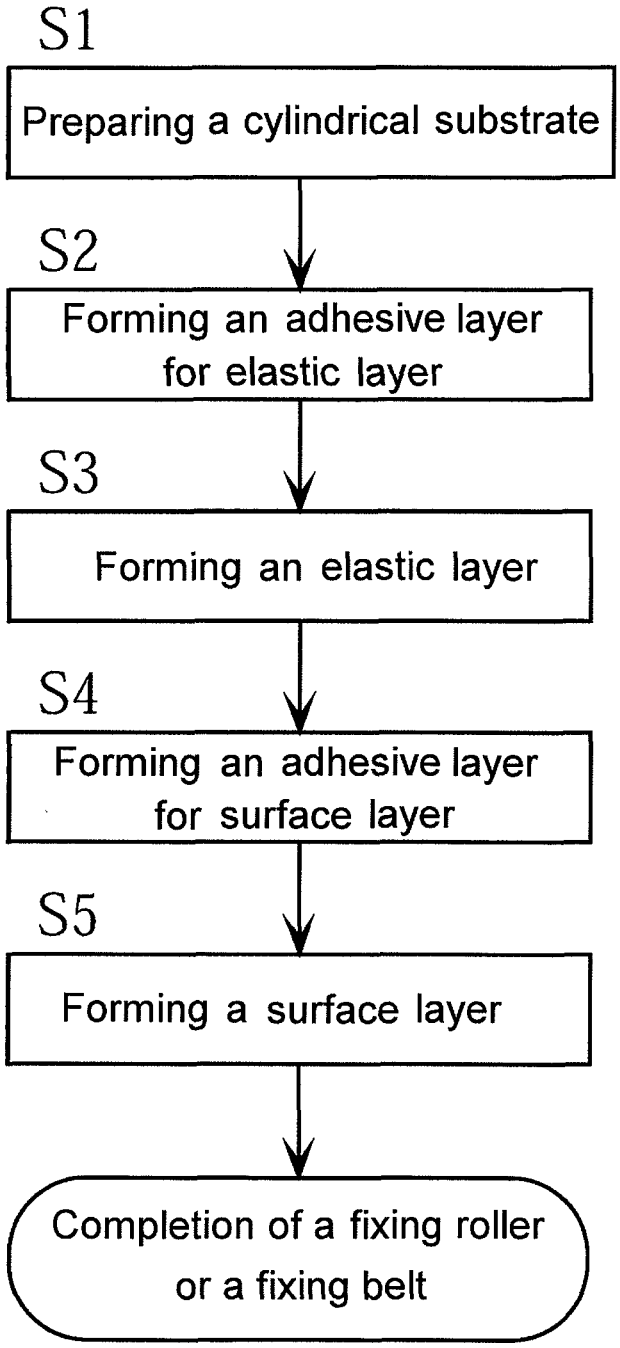
FIG. 2 is a flow chart showing manufacturing steps of a fixing roller/fixing belt according to an embodiment of the present invention.

The fixing roller/fixing belt consisting of the above-mentioned structure can be made by the manufacturing method as shown in the flow chart of FIG. 2, for example.

First, the cylindrical substrate 1 is prepared in Step S1. For example, a polyimide cylindrical substrate 1 is made in the below-described method. That is, a polyimide varnish is applied around a drum-shaped mold having a given outer diameter and length while the drum-shaped mold is turned, and the mold is heated to cause imide reaction so that the polyimide cylindrical substrate 1 may be made in a thickness of about 50 μm around the mold.

Next, in Step S2, an adhesive for the elastic layer is applied in a film form on the cylindrical substrate 1 so that the adhesive layer 4 for the elastic layer is formed. To improve the adhesive strength between the cylindrical substrate 1 and the adhesive layer 4 for the elastic layer, the adhesive layer 4 for the elastic layer may be formed in a manner such that an extremely thin silicon oxide layer is formed on the outer circumferential surface of the cylindrical substrate 1 and thereafter an adhesive for the elastic layer is applied around the outer circumference of the silicon oxide layer.

Figure 3:
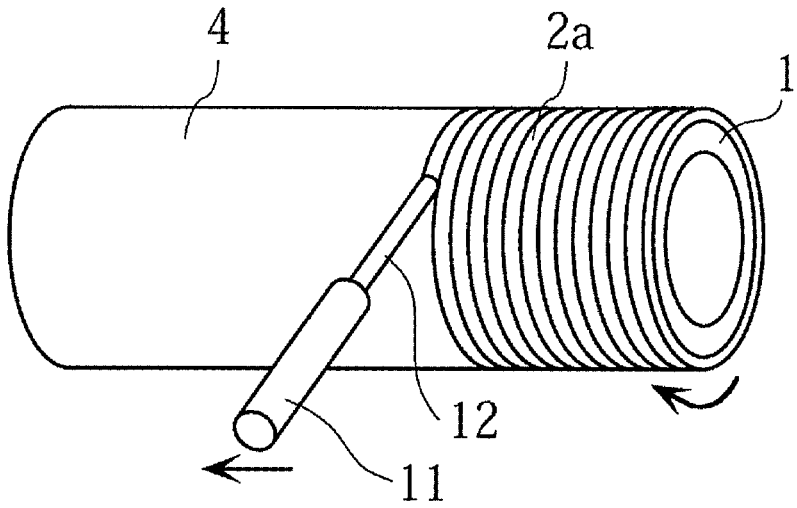
FIG. 3 is a conceptional perspective view for illustrating a method of forming an elastic layer.

Next, in Step S3, the elastic layer 2 is formed on the adhesive layer 4 for the elastic layer. That is, while the cylindrical substrate 1 is turned round in the circumferential direction as shown in FIG. 3, a liquid silicone rubber 2*a* is continuously supplied onto the surface of the adhesive layer 4 for the elastic layer from the ventage of the supply part 12 of a dispenser 11. As the supply part 12 of the dispenser 11 is moved continuously along the turning axis of the cylindrical substrate 1, the liquid silicone rubber 2*a* is applied spirally around on the surface of the adhesive layer 4 for the elastic layer. The liquid silicone rubber 2*a* thus spirally applied becomes a smooth coating layer as the neighboring parts of the silicone rubber 2*a* are united and further flattened by weight or centrifugal force to form an even liquid surface. Subsequently, the liquid silicone rubber 2*a* is hardened by a heat treatment to form the elastic layer 2.

Next, in Step S4, a surface-layer adhesive material is applied in a film form onto the elastic layer 2 so as to form the adhesive layer 5 for the surface layer. As for the surface-layer adhesive material, the above-mentioned PR-990CL available from Du Pont-Mitsui Fluorochemicals Co., Ltd. is used. Since the surface-layer adhesive material is not required to exhibit a lubrication function, it can be made in a thin thickness (5 μm or less). Therefore, the heat of a heater arranged inside the fixing roller/fixing belt spreads efficiently, resulting in decrease in the thermal loss.

Figure 4:
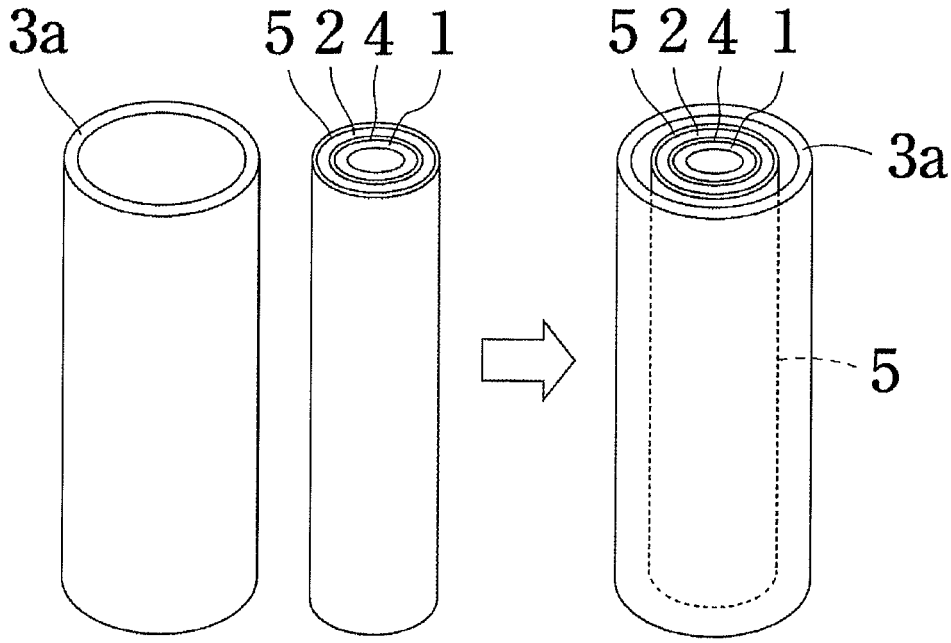
FIG. 4 is conceptional perspective views for illustrating a method of forming a surface layer.

Next, in Step S5, the surface layer 3 is formed on the adhesive layer 5 for the surface layer. That is, as shown in FIG. 4, the cylindrical substrate 1 is inserted into the PFA tube 3*a*, and the PFA tube 3*a* having heat shrinkable property is covered on the adhesive layer 5 for the surface layer. As for the PFA tube 3*a*, SMT made by Gunze Limited is used. The PFA tube 3*a* is designed to have an inner diameter that is slightly larger than the diameter of the outer circumference of the elastic layer 2 so that the cylindrical substrate 1 having the elastic layer 2 formed on the outer circumferential surface thereof may be inserted smoothly into the PFA tube 3*a*.

Subsequently, by heating at a temperature above the melting point of the PFA, the PFA tube 3*a* is heat-shrunk and the PFA of the PFA tube 3*a* and the PFA of the adhesive layer 5 for the surface layer are fused so that the outer circumferential surface of the elastic layer 2 and the inner circumferential surface of the PFA tube 3*a* are bonded together at melting point through the adhesive layer 5 for the surface layer. Thus, the surface layer 3 having a smooth outer circumferential surface can be formed on the elastic layer 2. As a result, the process of squeezing the surface of the PFA tube 3*a* is either unnecessary or simplified, enabling a low-cost fixing roller/fixing belt.

Although heating is done at a temperature above the melting point of the PFA in order to achieve bonding at melting point, the temperature is 310° C., and moreover the heating time is short. Since such low-temperature bonding is possible, the thermal deterioration of silicone-based rubber of the elastic layer 2 can be suppressed.

Hereinafter, the present invention will be explained in reference to Examples and Comparative examples.

EXAMPLE 1

First, in Step S1, a stainless steel cylinder having an inner diameter of 24 mm, a wall thickness of 30 μm, and a length of 279.5 mm was prepared as a cylindrical substrate.

Next, in Step S2, an adhesive layer for the elastic layer having a thickness of 3 was formed on the cylindrical substrate such that X-33-173 (monomer (resin)) made by Shin-Etsu Chemical Co., Ltd. was applied in a thin film form as the adhesive for the elastic layer and thereafter it was dried. In such case, depending on the characteristics as desired, a very thin silicon oxide layer is appropriately formed in advance on the outer circumferential surface of the cylindrical substrate, and subsequently the adhesive for the elastic layer is applied around the outer circumference thereof so as to form the adhesive layer for the elastic layer.

Next, in Step S3, an elastic layer having a thickness of 275 μm was formed in a manner such that a silicone rubber whose thermal conductivity is made to be 1.1 W/m·K by filling a filler (e.g., alumina) to afford thermal conductivity into a general-purpose rubber having a low thermal conductivity of 0.3 to 0.4 W/m·K (made by Shin-Etsu Chemical Co., Ltd.: X-34-2008) is applied with a dispenser on the surface of the adhesive layer for the elastic layer, followed with a heat treatment.

Next, in Step S4, an adhesive layer for the surface layer was formed in 3 μm thickness on the elastic layer in a manner such that PR-990CL, which contains PFA and available from Du Pont-Mitsui Fluorochemicals Co., Ltd., was applied as a surface-layer adhesive.

Next, in Step S5, the cylindrical substrate having an adhesive layer for the surface layer formed therearound was inserted in a PFA tube having a heat shrinkable property (made by Gunze Limited: SMT) with an inner diameter of 25 mm. In this case it was possible to achieve smooth insertion, since the inner diameter of the PFA tube was larger than the outer diameter of the circumferential surface of the elastic layer. Under such condition, the PFA tube was left for 4 minutes in an atmosphere of 290 to 300° C. so that it heat-shrunk by 13 to 15% to cover the elastic layer in a closely adhering manner. Thereafter, the PFA of the PFA tube and the PFA of the adhesive layer for the surface layer were fused by further heating to a temperature above the melting point of the PFA, and thereby the outer circumferential surface of the elastic layer and the inner circumferential surface of the PFA tube were bonded at melting-point through the adhesive layer for the surface layer, so that a surface layer having a thickness of 20 μm was formed on the elastic layer. Thus, the fixing belt of Example 1 was prepared. The outer circumferential surface of the fixing belt thus obtained was smooth and even, and there were no recognizable wrinkles, sagging, etc. of the PFA tube.

EXAMPLE 2

This example is an example of making a fixing belt having an elastic layer of higher heat conductivity. More specifically, a fixing belt of Example 2 was obtained in the same manner as Example 1 except that in Step S3 an elastic layer was formed by using a silicone rubber having a high heat conductivity of 1.3 W/m·K which was prepared by filling a filler (e.g., alumina) to afford thermal conductivity into a general-purpose rubber having a low thermal conductivity of 0.3 to 0.4 W/m·K (made by Shin-Etsu Chemical Co., Ltd.: X-34-2008).

COMPARATIVE EXAMPLE 1

This comparative example is an example of making a fixing belt according to the conventional method in which a non-shrinkable PFA tube is used as a surface layer. More specifically, first, an elastic layer like Example 1 was formed. Next, a silicone rubber made by Shin-Etsu Chemical Co., Ltd was applied in 275 μm thickness as a surface-layer adhesive to the outer circumferential surface of the elastic layer. Then, while a non-heat-shrinkable PFA tube having an inner diameter of 23 mm (made by Kurabo Industries Ltd.: Kuranfron) was being expanded, the cylindrical substrate having the surface-layer adhesive applied thereon was inserted compulsorily into the PFA tube. Subsequently, the outer circumferential surface of the PFA tube was made flat and smooth by squeezing the surface of the PFA tube to remove the excessive surface-layer adhesive and the wrinkles, sagging, etc. of the PFA tube and voids which occurred between the PFA tube and the elastic layer when the cylindrical substrate was inserted. Thereafter, the fixing belt of Comparative example 1 was obtained by forming a surface layer in 20 μm thickness over the elastic layer through the surface-layer adhesive by heating under a temperature of 220° C. for 120 minutes.

COMPARATIVE EXAMPLE 2

This comparative example is another example of a fixing belt by a conventional method corresponding to Example 2. More specifically, the fixing belt of Comparative example 2 was obtained in the same manner as Comparative Example 1 except that an elastic layer was formed by using a silicone rubber having a high heat conductivity of 1.3 W/m·K which was prepared by filling a filler (e.g., alumina) to afford thermal conductivity to the general-purpose rubber having a low thermal conductivity of 0.3 to 0.4 W/m·K (made by Shin-Etsu Chemical Co., Ltd.: X-34-2008) like Example 2.

(Evaluation of the Characteristics)

Using the fixing belts prepared in the respective Examples and Comparative Examples, evaluation was conducted with respect to the adhesive strength, fixing property, and fixing temperature. The specifics of the evaluation are as follows.

(1) Adhesive Strength

The adhesive strength between the elastic layer and the surface layer was measured with respect to each fixing belt such that 90° Peeling Test was conducted by 1 cm width, measuring the adhesive strength with a spring scale. The adhesive strength measuring tests were performed before (initial stage) and after the heat treatment in which the test pieces were left under an atmosphere of 210° C. for 300 hours.

(Fixing Property)

The fixing property was evaluated with respect to each fixing belt such that an image was formed with fixing equipment and the fixed part was rubbed.

(Fixing Temperature)

Fixing temperatures were measured using the respective fixing belts. The evaluation is shown in terms of the temperature variation ratio (%) relative to the fixing temperature of the Comparative Examples. The results of the evaluation is shown in Table I.

TABLE 1

| | | Example 1 | Example 2 | Comparative Example 1 | Comparative Example 2 |
|---|---|---|---|---|---|
| Adhesive strength (N/cm) | Initial stage | 2.70 | 3.14 | 1.76 | 1.57 |
| | After heat treatment | 3.43 | 2.94 | 0.98 | 1.96 |
| Fixing property | | ◎ | ◎ | ○ | ○ |
| Fixing temperature | | −5% | −5% | — | — |

As shown in Table I, after the heat-treatment (210° C.×300 hours) as well as in the initial stage, the fixing belts having the surface layer formed using a heat-shrinkable tube (Examples 1 and 2) have superior adhesive strength between the elastic layer and the surface layer, as compared to the conventional fixing belts having the surface layer formed using a non-heat-shrinkable tube (Comparative Examples 1 and 2).

As for Examples 1 and 2, the fixing property is also superior to Comparative Examples, and it is understood that the heat of the heater efficiently spreads through the surface without unevenness.

Moreover, the fixing temperature decreases by 5%, thereby enabling more quick start, which will result in energy saving.

The invention claimed is:

1. A method of making a fixing roller and/or fixing belt having an elastic layer and a surface layer formed on a substrate material in the enumerated order, the method comprising:

applying a PFA-containing adhesive material, in which the quantity of PFA contained is 20 to 30 wt %, to the outer circumferential surface of the elastic layer formed on the substrate material; inserting the substrate material into a PFA tube having a heat shrinkable property, the inner circumferential surface of the PFA tube being not subjected to internal treatment;

subsequently heating the PFA tube at a temperature above the melting point of the PFA so as to cause the PFA tube to shrink such that the outer circumferential surface of the elastic layer and the inner circumferential surface of the PFA tube are bonded together with the PFA-containing adhesive material so that a PFA layer is formed as the surface layer on the elastic layer.

2. The method of making a fixing roller and/or fixing belt as set forth in claim 1, wherein the ratio of heat shrinkage of the PFA tube forming the surface layer is 3 to 20%.

3. The method of making a fixing roller and/or fixing belt as set forth in claim 1 or 2, wherein the elastic layer is a silicone-based rubber.

* * * * *